United States Patent [19]

Minami et al.

[11] Patent Number: 4,856,574

[45] Date of Patent: Aug. 15, 1989

[54] ELECTRIC BLIND APPARATUS

[75] Inventors: Katsuji Minami, Osaka; Shinichi Murata, Yao; Susumu Tsujimoto, Fujiidera; Yukinori Matuzaki, Yao; Shogo Yukawa, Osaka; Susumu Osaka, Machida, all of Japan

[73] Assignees: Sharp Kabushiki Kaisha, Osaka; Kabushiki Kaisha Nichibei, Tokyo, both of Japan

[21] Appl. No.: 139,024

[22] Filed: Dec. 29, 1987

[30] Foreign Application Priority Data

| | | | |
|---|---|---|---|
| Dec. 29, 1986 | [JP] | Japan | 61-314183 |
| Dec. 29, 1986 | [JP] | Japan | 61-314184 |
| Dec. 29, 1986 | [JP] | Japan | 61-314185 |
| Dec. 29, 1986 | [JP] | Japan | 61-314186 |
| Dec. 29, 1986 | [JP] | Japan | 61-314187 |
| Dec. 29, 1986 | [JP] | Japan | 61-314188 |
| Dec. 29, 1986 | [JP] | Japan | 61-314189 |
| Dec. 29, 1986 | [JP] | Japan | 61-314190 |
| Jun. 3, 1987 | [JP] | Japan | 62-139544 |

[51] Int. Cl.[4] ..... E06B 9/30

[52] U.S. Cl. ..... 160/168.1; 160/188; 160/166.1

[58] Field of Search ..... 160/168.1, 166.1, 900, 160/188, 310, 311, 7, 8

[56] References Cited

U.S. PATENT DOCUMENTS 3,809,143 5/1974 Ipekgil ..... 160/168.1

FOREIGN PATENT DOCUMENTS 1659977 7/1970 Fed. Rep. of Germany .
2839146 3/1980 Fed. Rep. of Germany .
56-1767 4/1981 Japan .
56-17676 4/1981 Japan .
86/04109 7/1986 PCT Int'l Appl. .
86/04382 7/1986 PCT Int'l Appl. .

*Primary Examiner*—Blair M. Johnson
*Attorney, Agent, or Firm*—Birch, Stewart, Kolasch & Birch

[57] ABSTRACT

When a raising switch (21) or a lowering switch (23) is operated in an electric blind apparatus, an MPU (34) rotates a geared motor (4) so that a take drum (37) winds up or unwinds a lifting tape (10) to raise/lower vanes (13) of a blind. Upon rotation of the take-up drum, a photointerrupter (38) generates pulse signals and the MPU counts the pulse signals to judge a vertical position of the blind. When an opening or closing switch (24, 26) is operated, the MPU rotates the geared motor so that a ladder drum (39) is followingly rotated to wind up one of ladder cords (11) fixed to the ladder drum, thereby to adjust an open/close angle of the vanes. Following rotation of the ladder drum, a photointerrrupter (41) supplies pulse signals to the MPU, which in turn counts the pulse signals to judge the open/close angle of the vanes.

13 Claims, 11 Drawing Sheets

ELECTRIC BLIND APPARATUS

BACKGROUND OF THE INVENTION

1. Field of the Invention

The present invention relates to an electric blind apparatus. More specifically, it relates to an electric blind apparatus which can raise/lower a blind by an electric motor while opening/closing vanes of the blind.

2. Description of the Prior Art

Various types of electrified automatic blinds have recently been proposed for installation in an office, a board room, a store and the like. Such convenient automatic blinds are increasingly coming into wide use, to be further spread for domestic use in the near future.

Japanese Utility Model Publication Gazette No. 17676/1981 discloses an example of such an automatic blind. This automatic blind includes a switch for changing the direction of rotation of a DC motor, so that the DC motor is normally or reversely rotated by the switch to raise/lower the blind by its driving force. The DC motor is stopped when the blind reaches an upper or lower limit position. However, this automatic blind is merely adapted to raise/lower the blind, and a period of turn-on of the motor is merely controlled according to an output of an oscillation circuit to regulate vanes thereof at an arbitrary open/close angle.

SUMMARY OF THE INVENTION

Accordingly, a principal object of the present invention is to provide an electric blind apparatus, which can raise/lower a blind to an arbitrary position while controlling vanes thereof at an arbitrary open/close angle.

Briefly stated, the present invention is adapted to drive an electric motor in response to a raising/lowering command from command means for raising/lowering the blind, while driving the electric motor in response to an open/close command from the command means to open/close a plurality of vanes by vane opening/closing means.

Thus, according to the present invention, the plurality of vanes of the blind can be simultaneously adjusted in an open/close angle by simply supplying an opening/closing command from the command means.

In a preferred embodiment of the present invention, movement of the blind to an upper limit position is detected to stop the electric motor, and vertical positions of the blind are discriminated during downward movement of the blind to stop the electric motor when the blind is lowered to a predetermined lower limit position.

Thus, according to the preferred embodiment of the present invention, the blind can be raised/lowered to an arbitrary position in response to a raising/lowering command, while such raising/lowering of the blind is automatically stopped when the same reaches an upper limit position or a set lower limit position.

In a more preferred embodiment of the present invention, the blind is automatically lowered to the predetermined lower limit position upon power supply or power reset after service interruption.

In a further preferred embodiment of the present invention, an open/close angle of the vanes before raising/lowering is detected and stored before the blind is raised/lowered, to adjust the open/close angle of the vanes after raising/lowering to be in coincidence with the stored open/close angle.

In a further preferred embodiment of the present invention, looseness of a cord-like member for raising/lowering a plurality of vanes is detected to stop the electric motor upon detection of such looseness.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

These and other objects, features, aspects and advantages of the present invention will become more apparent from the following detailed description of the present invention when taken in conjunction with the accompanying drawings.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
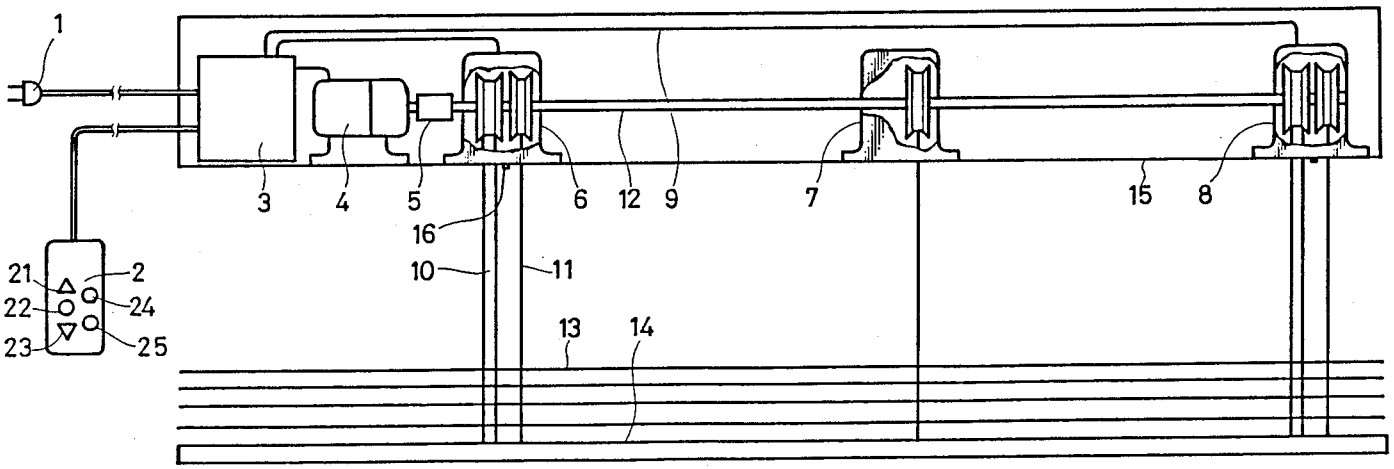
FIG. 1 schematically illustrates an embodiment of the present invention.
Figure 2:
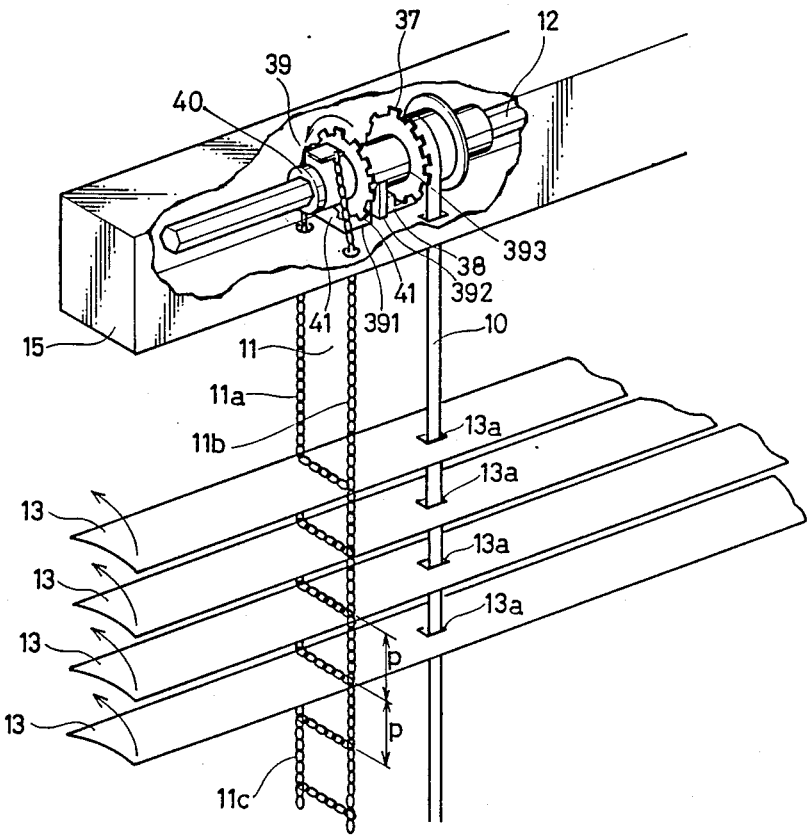
FIG. 2 illustrates a principal part of a take-up mechanism for a blind.

FIG. 1 schematically illustrates an embodiment of the present invention, and FIG. 2 illustrates a principal part of a take-up mechanism for a blind.

Referring to FIGS. 1 and 2, description is now made on outer structure of the embodiment. A power supply cord 1 and a controller 2 are connected to a control part 3. The controller 2 is provided with a raising switch 21 for commanding raising of the blind, a stop switch 22 for commanding stoppage thereof, a lowering switch 23 for commanding lowering, an opening switch 24 for commanding opening of vanes (hereinafter referred to as slats) 13 of the blind and a closing switch 25 for providing a command for closing the slats 13. The control part 3 stores a microcomputer, a power supply part and the like. A geared motor 4, which is formed by an electric motor and a reduction gear, is connected to the control part 3.

The rotary shaft of the geared motor 4 is coupled to a lifting shaft 12 through a coupling 5. The lifting shaft 12 is coupled with lifting units 6, 7 and 8. Sensors, trouble switches (not shown) and upper limit switches 16 contained in the lifting units 6, 7 and 8 are connected to the control part 3 by interconnection members 9. The interconnection members 9 are also adapted to interconnect these elements with the geared motor 4 and the controller 2. The lifting units 6 and 8 include take-up drums 37 and ladder drums 39, while the lifting unit 7 only includes a ladder drum 39.

An end of a lifting tape 10, which may be in the form of a cord, is fixed to each take-up drum 37. The other end of the lifting tape 10 is fixed to a bottom rail 14 through holes 13*a* of the slats 13. The take-up drum 37 winds or unwinds the lifting tape 10 upon rotation of the lifting shaft 12, to raise or lower the slats 13 and the bottom rail 14.

An end of a ladder cord member 11 is fixed to each ladder drum 39, and the other end thereof is fixed to the bottom rail 14. The ladder cord member 11 is formed by a pair of ladder cords 11*a* and 11*b*, which are separated by a space corresponding to a width of 50 mm, 25 mm or 15 mm, for example, of the slats 13 from each other. The pair of ladder cords 11*a* and 11*b* are connected with each other by pairs of lateral cord 11*c* at regular intervals corresponding to the pitch p of the slats 13 in the form of a ladder, for example. Upon rotation of the ladder drum 39, therefore, one of the ladder cords 11*a* and 11*b* is wound and the other one is unwound to change the angle of the slats 13.

Further, the ladder drum 39 is formed with a projection 393, and a stopper 392 is provided in proximity to the ladder drum 39. The stopper 392 is positioned to be in contact with the projection 393 when the ladder drum 39 is rotated so that the slats 13 are in vertical states, i.e., when the blind is closed. Another stopper 392 (not shown) is provided in a position to be in contact with another projection 393 (not shown) when the slats 13 are reversely rotated to be in vertical states. Thus, the ladder drum 39 can be rotated between the both stoppers 392, to be stopped when either projection 393 is in contact with either stopper 392. At this time, the take-up drum 37 idles with rotation of the lifting shaft 12.

Each slat 13 is inserted and held in the form of a a quadrangle ladder defined by the ladder cords 11*a* and 11*b* and each pair of lateral cords 11*c*. The ladder drum 39 is rotated following rotation of the lifting shaft 12, to adjust the degree of opening of the slats 13. The bottom rail 14 serves as a dead weight for pulling down the blind and preventing the blind from being swung by wind or the like after lowering.

The control part 3, the geared motor 4 and the lifting units 6, 7 and 8 are covered by a head box 15 forming an outer casing. The head box 15 is provided in its lower portion with an upper limit switch 16, which is pressed by the slats 13 when the blind is drawn up, to detect an upper limit position. This upper limit switch 16 may be formed by an electronic switch such as an optical sensor.

Figure 3:
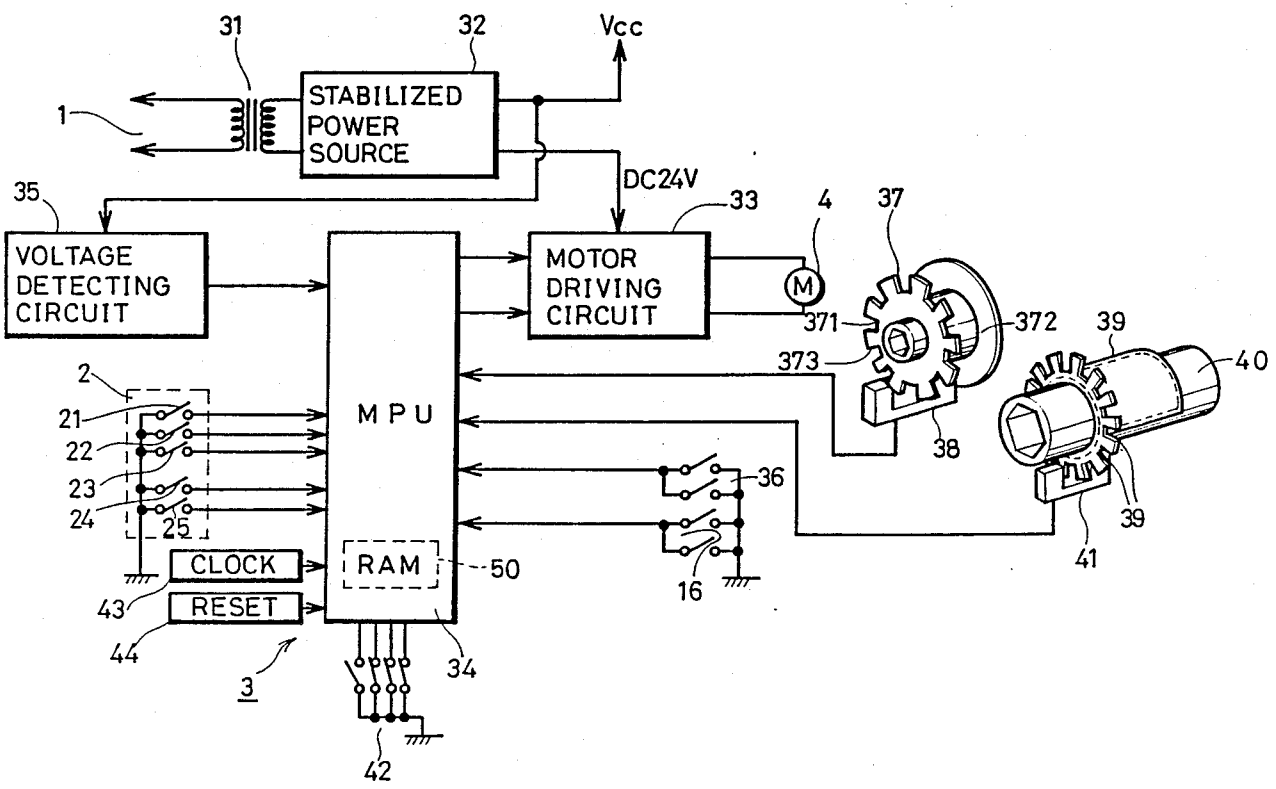
FIG. 3 is a schematic block diagram showing the embodiment of the present invention.

FIG. 3 is a schematic block diagram showing an electrical structure of the embodiment of the present invention. Referring to FIG. 3, description is now made of the electrical structure of the embodiment. A power transformer 31 receives AC power through the power supply cord 1. The power transformer 31 steps down the received AC power to supply low voltage to a stabilized power supply part 32, thereby to produce power required for the control part 3 and the geared motor 4. A motor driving circuit 33 is connected to a microcomputer (hereinafter referred to as MPU) 34, to normally or reversely rotate the geared motor 4 or control the same in a brake mode in response to a command from the MPU 34.

The brake mode is adapted to cause a short across input terminals of the geared motor 4 through the motor driving circuit 33, thereby to brake the geared motor 4. When torque is mechanically applied to the geared motor 4 by inertia following lowering of the blind or strong pulling of the blind for artificially lowering the same, for example, the geared motor 4 causes back electromotive force forming the principle of a DC generator. Thus, a short is so caused across the input terminals that current flows to prevent such torque, i.e., to reversely rotate the geared motor 4, thereby to stop the same. This brake mode will hereinafter be described in further detail with reference to FIGS. 9 to 11.

The MPU 34 is connected with a voltage detecting circuit 35, which is adapted to detect the voltage of a power source $V_{CC}$ supplied to the control part 3. In other words, the voltage detecting circuit 35 monitors voltage supplied from the power supply cord 1 through the transformer 31 in a low-voltage side. The MPU 34 is further comprised with a RAM 50 for storing data.

A trouble switch 36 is contained in the lifting unit 6, to detect a trouble against raising/lowering of the blind. For example, the blind may touch an obstacle or the like during downward movement and be stopped as a result. If the geared motor 4 is continuously rotated in the lowering direction in this case, the lifting tape 10 is loosened to be displaced from the take-up drum 37 upon further continuation of such rotation. In this case, therefore, the lifting tape 10 cannot be wound up for raising the blind in turn.

In order to prevent this, looseness of the lifting tape 10 is detected by a looseness detecting mechanism as shown in FIGS. 14A and 14B or 15A and 15B as hereinafter described, to input detection output thereof in the MPU 34, thereby to stop the geared motor 4 through the motor driving circuit 33. Namely, the MPU 34 sets the motor driving circuit 33 in the brake mode on the basis of output from the trouble switch 36. Further, the MPU 34 reversely rotates the geared motor 4 by an arbitrary period upon stoppage thereof to draw up the blind, and stops the geared motor 4 after correcting the loosened lifting tape 10.

The take-up drum 37 includes guides 371 and 372 for the lifting tape 10. Slits 373 are formed in the periphery of the guide 371, for example. Alternatively, a disc may be mounted on another portion of the lifting shaft 12 separately from each take-up drum 37 to be provided with such slits for detecting rotation of the lifting shaft 12 or that of the geared motor 4 or the motor shaft thereof, to attain a similar effect.

A photointerrupter 38 is provided in relation to the guide 371 of the take-up drum 37. The photointerrupter 38 optically detects interruption of the slits 373 defined in the guide 372 of the take-up drum 37 and converts the rotation of the lifting shaft 12 into an electric signal, to input the same in the MPU 34. In other words, the MPU 34 can recognize the amount of raising or lowering of the lifting tape 10 by the electric signal through rotation of the take-up drum 37. One end of the ladder cord member 11 is fixed to the ladder drum 39 as hereinabove described, whereby the slats 13 can be changed in angle by rotation of the ladder drum 39 to change the amount of incidence of external light, thereby to control brightness in the room or intercept the external light.

The ladder drum 39 is fitted with the lifting shaft 12 with frictional force through a drum shaft 40 receiving the lifting shaft 12. The lifting shaft 12 and the drum shaft 40 are rotated integrally (synchronously) with each other, while the projection 393 as shown in FIG. 2 is brought into contact with the stopper 392 when the ladder drum 39 is substantially half-rotated to stop the rotation of the ladder drum 39, which in turn slips with the drum shaft 40 to idle. When the lifting shaft 12 is reversely rotated, the ladder drum 39 is also reversely rotated, to idle upon contact of the projection 393 with the stopper 392, similarly to the above. The slats 13 are rotated clockwise by the substantially half rotation of the ladder drum 39, to be changed in angle. Namely, the slats 13 are changed from inwardly inclinedly closed states into horizontally opened states, and further changed into outwardly inclinedly closed states. When the lifting shaft 12 is rotated in a direction reverse to the above, the slats 13 are moved counterclockwise in angle. Namely, the slats 13 are changed from the outwardly inclinedly closed states to the horizontally opened states, and further changed into the inwardly inclinedly closed states.

Slits 391 are formed in an end of the ladder drum 39 to detect rotation thereof. The slits 391 are provided at an angle corresponding to the substantially half rotation of the ladder drum 39, and a photointerrupter 41 is provided to detect positions of the slits 391. The photointerrupter 41 detects the positions of the slits 391 to convert the same into an electric signal, which is supplied to the MPU 34. The MPU 34 can recognize the angle of the ladder drum 39, i.e., the angle of the slats 13 in response to the electric signal. A lower limit set switch member 42 is adapted to set a lower limit position of downward movement of the blind, and is formed by four switches. The number of the switches included in the lower limit set switch member 42 is not restricted to four but may be arbitrarily determined, depending on the degree of fine setting of the lower limit position.

Respective switches 21 to 25 of the controller 2, a clock generator 43 and a reset circuit 44 are connected to the MPU 34.

Figure 4:
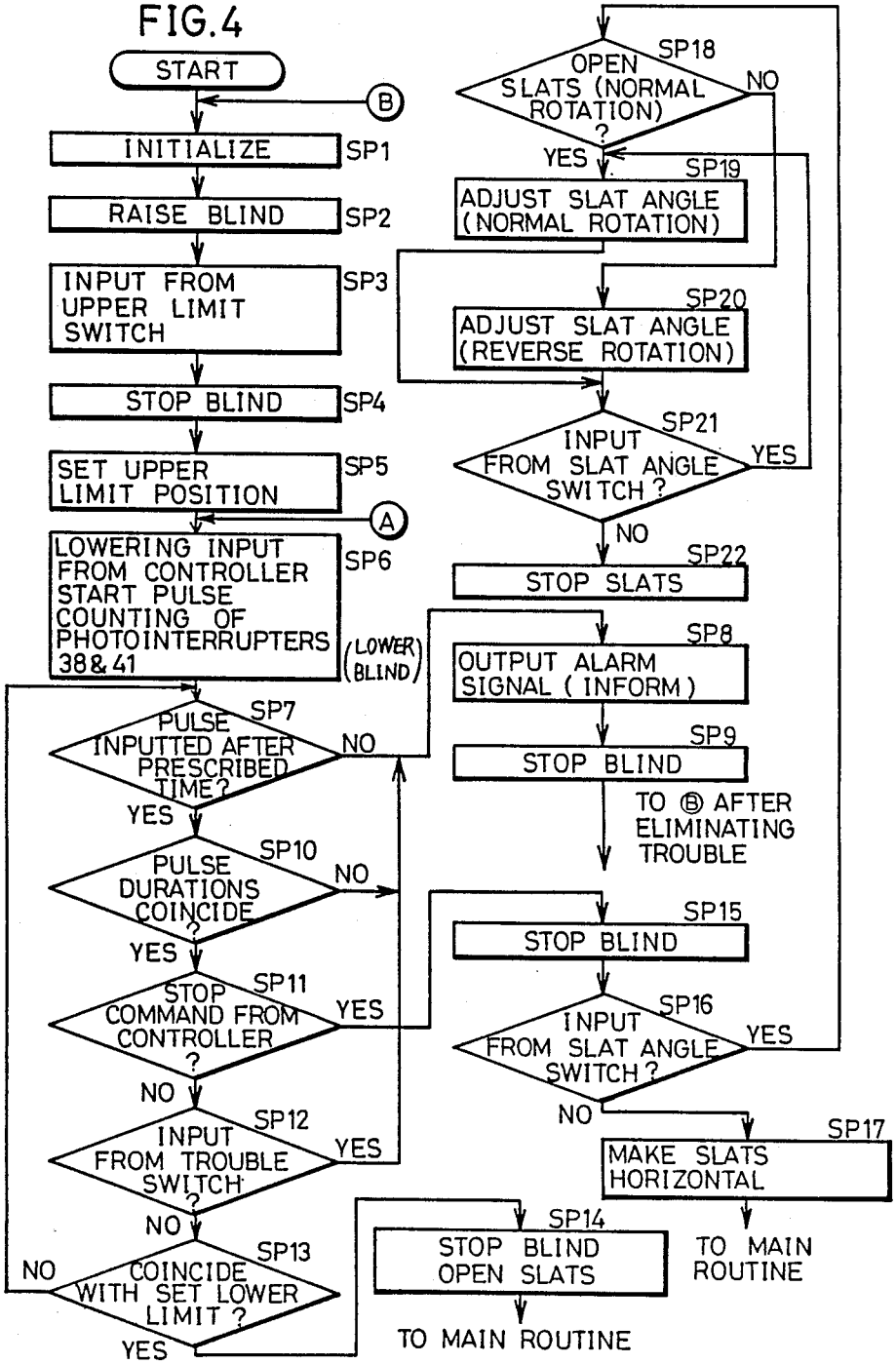
FIG. 4 is a flow chart for illustrating operation of the embodiment.

FIG. 4 is a flow chart for illustrating operation of the embodiment.

Referring to FIGS. 1 to 4, description is now made of the operation of this embodiment. The electric blind apparatus is set on a prescribed window frame, and the lower limit position is set at an appropriate value by the lower limit set switch member 42. The MPU 34 is initially reset upon power supply. The voltage detecting circuit 35 detects voltage of the stabilized power source 32, to supply a voltage detecting signal to the MPU 34 after a slight delay time. In response to the voltage detecting signal, the MPU 34 resets and initializes an external register and the like at a step (referred to as SP in the figure) SP1. Such initialization is similarly performed by a reset switch (not shown).

Then, at a step SP2, the MPU 34 outputs a raising signal to the motor driving circuit 33, in order to raise the blind. The motor driving circuit 33 responsively rotates the geared motor 4. Upon rotation of the geared motor 4, the lifting shaft 12 is rotated to raise the blind, whereby each lifting tape 10 is wound up by the take-up drum 37 to raise the blind.

The MPU 34 continuously rotates the geared motor 4 until the upper limit switch 16 is pressed by the slats 13 so that a signal indicating that the blind reaches the upper limit position is inputted at a step SP3. Upon input of the signal from the upper limit switch 16, the MPU 34 supplies a stop signal to the motor driving circuit 33 at a step SP4. The motor driving circuit 33 responsively puts the geared motor 4 in the brake mode to stop the blind. At a step SP5, the MPU 34 clears a memory contained therein, to set the upper limit position.

When the lowering switch 23 of the controller 2 is operated to lower the blind, the MPU 34 supplies a lowering signal to the motor driving circuit 33 at a step SP6. The motor driving circuit 33 responsively rotates the geared motor 4 in a direction reverse to that for raising. Upon rotation of the geared motor 4, each take-up drum 37 is rotated reversely to the above, whereby the lifting tape 10 is unwound from the take-up drum 37 to lower the blind. At this time, the MPU 34 reads pulse signals transmitted from the photointerrupters 38 and 41, provided in relation to the take-up drum 37 and the ladder drum 39 respectively, to start counting of the same. At a step SP7, the MPU 34 determines whether the pulse signals are inputted from the photointerrupters 38 and 41 after a prescribed time. If the pulse signals are not inputted within the predetermined time, it means that rotation of the geared motor 4 is prevented such as by locking. In this case, the MPU 34 outputs an alarm signal at a step SP8 to drive an annunciator (not shown) to inform of the abnormality. The MPU 34 further sends a stop signal to the motor driving circuit 33 at a step SP9, to bring the geared motor 4 into the brake mode.

Similarly, the MPU 34 determines whether pulse durations of the pulse signals received from the photointerrupters 38 and 41 are in coincidence with previously set values at a step SP10. If the durations of the pulse signals are not in coincidence with the predetermined values, the MPU 34 outputs an alarm signal at the step SP8 similarly to the above, to inform of the abnormality. At a step SP11, the MPU 34 determines whether or not the stop switch 22 of the controller 2 is operated to provide a stop command. If the stop switch 22 provides the stop command, the MPU 34 supplies a stop signal to the motor driving circuit 33, to temporarily put the geared motor 4 in the brake mode at a step SP15. At a step SP16, the MPU 34 determines whether a command is received from the opening switch 24 or the closing switch 25 of the controller 2, to intermittently rotate the geared motor 4 if no opening/closing command is received. Namely, the MPU 34 alternately repeats rotation and the brake mode of the geared motor 4 and counts the pulse signals received from the photointerrupter 41 to intermittently rotate the geared motor 4 until the slats 13 are brought into horizontal positions, and thereafter advances to a main routine for raising or lowering the blind.

At a step SP18, the MPU 34 determines whether or not a signal is received from the opening switch 24 or the closing switch 25 for adjusting the angle of the slats 13, to normally intermittently rotate the geared motor 4 while counting the pulse signals from the photointerrupter 41 at a step SP19 if a command is received from the opening switch 24, while reversely intermittently rotating the geared motor 4 at a step SP21 if a signal is received from the closing switch 25. When there is no input signal from the opening switch 24 or the closing switch 25, the MPU 34 brings the geared motor 4 into the brake mode, to stop opening/closing of the slats 13 at a step SP22.

If lowering of the blind is prevented by an obstacle or the like to loosen the lifting tape 10 and the trouble switch 36 detects trouble, the MPU 34 outputs an alarm signal at a step SP12 in response to a detection signal from the trouble switch 36 to inform of the abnormality, while stopping the geared motor 4. When the blind is stopped by such trouble, the MPU 34 returns to initialization after eliminating the trouble. When the value set by the lower limit set switch member 42 coincides with the count value of the pulse signals received from the photointerrupter 38 in the operation for lowering the blind, the MPU 34 judges that the blind reaches the lower limit position at a step SP13 and stops the geared motor 4 at a step Sl4, thereby to stop lowering of the blind. Thereafter the MPU 34 intermittently rotates the geared motor 4 to close the slats 13, thereby to advance to the main routine for raising or lowering the blind.

Thus, the slats 13 are closed when the blind is lowered after initialization to the lowermost position. When the blind is stopped during downward movement, the slats 13 are brought into horizontal states unless a command is received from the opening switch 24 or the closing switch 25.

In order to raise the blind, the raising switch 21 of the controller 2 is operated, to perform an operation reverse to that for lowering.

According to the above embodiment of the present invention, the geared motor 4 is driven by the MPU 34 in response to the raising/lowering command, the opening/closing command for the slats 13 and the detection signals from the various detecting means to raise/lower the blind and open/close the slats 13, whereby the components can be reduced in size and the steps for assembling the same can be reduced in number to reduce the cost, while the operation characteristic thereof can be improved.

Figure 5:
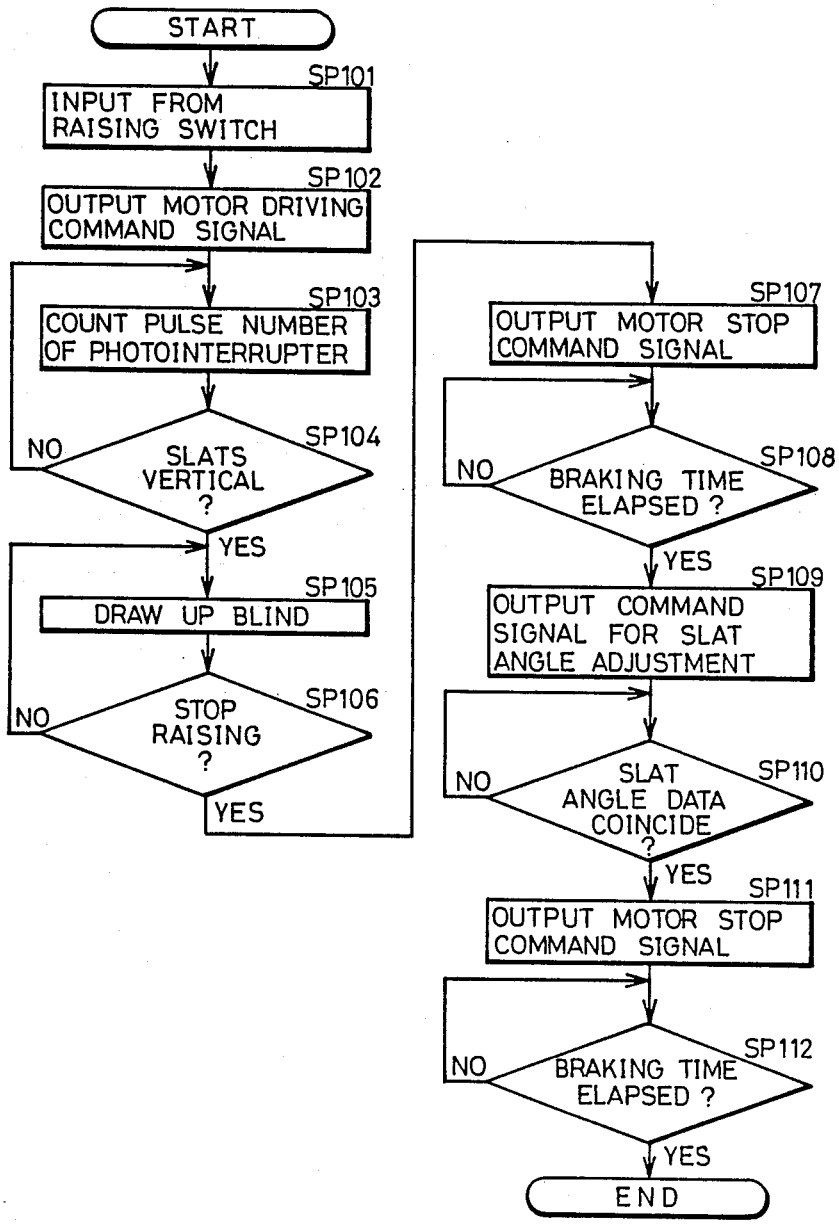
FIG. 5 is a flow chart showing another embodiment of the operation for raising the blind as shown in FIG. 4.

FIG. 5 is a flow chart showing another embodiment of the operation for raising the blind as shown in FIG. 4. This embodiment is adapted to control the slats 13 so that the open/close angle thereof after raising of the blind coincides with that before raising. When the raising switch 21 is pressed down at a step SP101 to raise the blind, the MPU 34 supplies a motor driving command signal to the motor driving circuit 33 at a step SP102, whereby the geared motor 4 is rotated. The ladder drum 39 is rotated in response to such rotation of the geared motor 4, so that the photointerrupter 41 outputs pulse signals. At a step SP103, the MPU 34 counts the pulse signals received from the photointerrupter 41, to determine whether the slats 13 are in vertical states at a step SP104, on the basis of counter output of the pulse signals from the photointerrupter 41.

If the slats 13 are in vertical positions, the MPU 34 makes the RAM 50 store the number of the pulse signals generated from the photointerrupter 41, i.e., data on angular movement of the slats 13 from a given open/close angle to the vertical positions. Then the MPU 34 supplies the motor driving circuit 33 with a motor driving command signal for continuously rotating the geared motor 4 at a step SP105, to raise the blind. At a step SP106, the MPU 34 determines that the stop command switch 22 is pressed down, to output a stop command signal to the motor driving circuit 33 at a step SP107. Thus, the rotation of the geared motor 4 is stopped.

The MPU 34 determines that a prescribed braking time has elapsed at a step SP108, to output a motor driving command signal to the motor driving circuit 33 at a step SP109 to return the slats 13 to the open/close angle before the raising operation. The motor driving circuit 33 responsively reversely rotates the geared motor 4. Following the rotation of the geared motor 4, the photointerrupter 41 outputs pulse signals, so that the MPU 34 counts the pulse signals generated from the photointerrupter 41 to compare the counter output with the angle data stored in the RAM 50. If such angle data coincide with each other, the MPU 34 outputs a motor stop command signal to the motor driving circuit 33 at a step SP111. At a step SP112, the MPU 34 returns to a general routine after a lapse of the prescribed braking time. Thus, the slats 13 are set at the open/close angle before raising operation.

Figure 6:
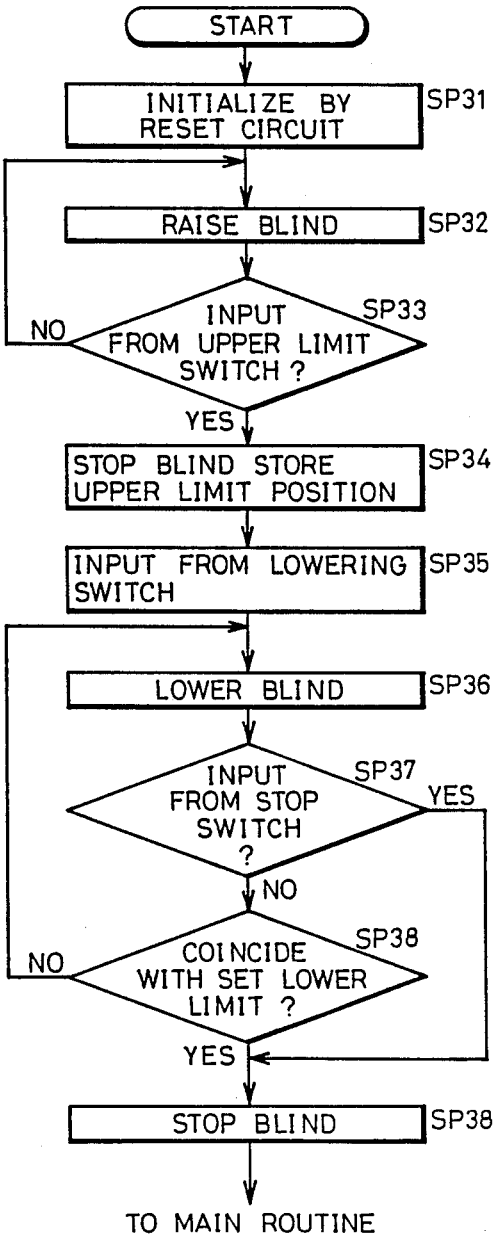
FIG. 6 is a flow chart showing an embodiment for lowering the blind to a position set by a lowering switch.

FIG. 6 is a flow chart showing an embodiment for lowering the blind to a position set by the lowering switch. In this embodiment, the lower limit set switch member 42 is formed by four switches 421 to 424 as shown in FIG. 3. Namely, 16 combinations of setting are enabled by four bits, so that the entire length of the blind can be set in 16 stages. The number of the switches included in the lower limit set switch member 42 can be increased from four to six or eight to subdivide the range of setting of the vertical position to 64 stages or 256 stages, while this embodiment enables setting in 16 stages by four switches for convenience of illustration.

The respective switches 411 to 424 of the lower limit set switch member 42 are appropriately combined to set the vertical position for lowering the blind. When the lower limit set switch member 42 is fully open, the blind is lowered the entire length. When the power supply plug 1 is energized in this state, the MPU 34 is initialized by the reset circuit 44 at a step SP31, so that the blind is drawn up. Namely, the MPU 34 closes the slats 13 at a step SP32 similarly to the above, while winding up the lifting tape 10 to draw up the slats 13 and the bottom rail 14. When the slats 13 are thus drawn up, the upper limit switch 16 provided in the head box 15 is turned on and the MPU 34 makes the motor driving circuit 33 stop the geared motor 4 in response to a determination on a signal from the upper limit switch 116 at a step SP33. At a step SP34, the MPU 34 stores an upper limit position in the RAM 50 by a pulse signal supplied from the photointerrupter 38 and the signal from the upper limit switch 16.

Then, upon operation of the lowering switch 23, the MPU 34 determines that the lowering switch 23 is operated at a step SP35 and supplies a lowering signal to the motor driving circuit 33 at a step SP36, to rotate the geared motor 4 thereby to lower the blind. Thus, the take-up drum 37 is rotated to unwind the lifting tape 10, so that the slats 13 are pulled down by the weight of the bottom rail 14. The blind is lowered by the weights of the bottom rail 14 and the slats 13, and the geared motor 4 is intermittently driven to brake such downward movement by the weight of the bottom rail 14, thereby to lower the blind at an appropriate speed.

At the same time, the slits 373 formed in the take-up drum 37 are rotated, so that the photointerrupter 38 supplies pulse signals to the MPU 34. At a step SP37, the MPU 34 determines that the stop switch 22 is not operated to count the pulse signals from the photointerrupter 38 and compare the counter values with data by combinations of the lower limit set switch member 42, through positional relation of counter values and vertical positions previously stored in a program. The MPU 34 judges coincidence of a counter value with the data set by the lower limit set switch member 42 at a step SP38, to supply a stop signal to the motor driving circuit 33 at a step SP39, thereby to stop the geared motor 4 and bring the same into a brake state.

When the lower limit set switch member 42 is fully open, the blind is unwound over the entire range of lowering, to be stopped at a lowered point. If the switch 424 of the lower limit set switch member 42 is closed and the remaining ones are open, the blind is stopped at a stage of 1/16 of the range of lowering. While 16 stages of lowering can be set by changing combinations of the respective switches included in the lower limit set switch member 42, such range of lowering can be arbitrarily set not in stages but in response to actual length, in accordance with a program and accuracy in response from the slits 373 formed in the take-up drum 37 and the photointerrupter 38, or the number of the switches included in the lower limit set switch member 42.

If normal lowering of the blind is prevented by an obstacle or the like, looseness of the lifting tape 10 is detected by the trouble switch 36, to stop the geared motor 4.

Figure 7:
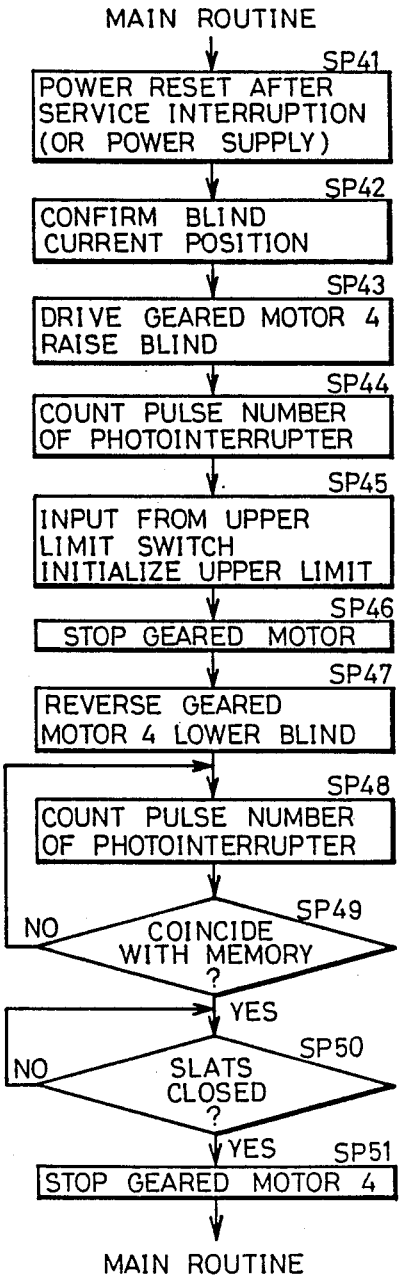
FIGS. 7 and 8 are flow charts showing an embodiment for reliably lowering the blind to a lowermost position upon power supply or power reset after service interruption.

FIG. 7 is a flow chart for illustrating operation of another embodiment of the present invention. This embodiment is adapted to reliably lower the blind to a lowermost position upon power supply or power reset after service interruption.

With reference to FIG. 7, a description is now made on the operation of this embodiment. At a step SP41, the MPU 34 is initially reset upon power supply or power reset after service interruption. The voltage detecting circuit 35 detects the voltage of the stabilized power source 32, to supply a voltage detecting signal to the MPU 34 after a slight delay time. At a step SP42, the MPU 34 reads output signals from the photointerrupters 38 and 41, to confirm the current position of the blind and the angle of the slats 13. Then the MPU 34 drives the geared motor 4 through the motor driving circuit 33 at a step SP43, to raise the blind. Namely, the MPU 34 rotates the take-up drum 37 by rotation of the geared motor 4 to wind up the lifting tape 10, thereby to raise the blind.

When the take-up drum 37 is thus rotated, the slits 373 formed in the guide 371 interrupt the output signal from the photointerrupter 38, to supply pulse signals to the MPU 34. The ladder drum 39 is also rotated at this time, so that the output from the photointerrupter 41 is interrupted by the slits 391 formed in the ladder drum 39, to supply pulse signals to the MPU 34. At a step SP44, the MPU 34 counts the pulse signals from the photointerrupter 38, to store the counter value. Upon raising of the blind, the slats 13 press the upper limit switch 16 so that the MPU 34 receives a signal indicating that the blind reaches the upper limit at a step SP45. The MPU 34 responsively brings the motor driving circuit 33 into the brake mode at a step SP46 to stop the geared motor 4, thereby to stop raising of the blind. Thus, the rotation of the take-up drum 37 is stopped so that the photointerrupter 38 outputs no pulse signal. Upon receiving no signal from the upper limit switch 16 and no pulse signal from the photointerrupter 38, the MPU 34 can recognize raising of the blind, i.e., the distance of raising of the blind by the number of revolutions of the take-up drum 37.

Then, at a step SP47, the MPU 34 outputs a signal for lowering the blind to the motor driving circuit 33 to reversely rotate the geared motor 4, thereby to lower the blind. At a step SP48, the MPU 34 sequentially counts pulse signals from the photointerrupter 38 similarly to the above, to lower the blind until the counter value coincides with that stored in the RAM 50 in raising of the blind. At a step SP49, the MPU 34 determines that the counter value coincides with that stored in the RAM 50, to bring the motor driving circuit 33 into the brake mode, thereby to stop the geared motor 4 for stopping lowering of the blind. Thus, upon power supply or power reset after service interruption, the blind is raised and then returned to the former position.

As hereinabove described, the blind is raised to set the upper limit position by the signal from the upper limit switch 16 and thereafter the blind is lowered upon power reset after service interruption, while it is easy to lower the blind until the set value of the lower limit switch member 42 coincides with the number of the pulse signals from the photointerrupter 38, i.e., to the lowermost position.

After the blind is lowered to the lowermost position as described above, the MPU 34 outputs a signal for raising the blind to the motor driving circuit 33, which in turn normally rotates the geared motor 4 to close the slats 13. At a step SP50, the MPU 34 discriminates a signal from the photointerrupter 41, which is provided in relation to the ladder drum 39, to judge that the slats 13 are rotated to be in closed states. If the slats 13 are in the closed states, the MPU 34 brings the motor driving circuit 33 into the brake mode at a step SP51, to stop the geared motor 4.

Figure 8:
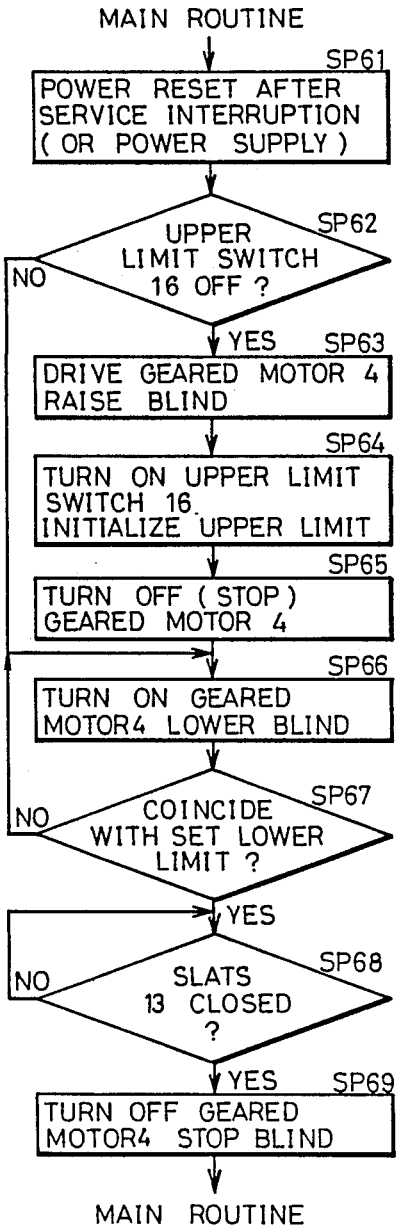

FIG. 8 is a flow chart for illustrating operation of a further embodiment of the present invention. While the blind is returned to the original position after the power is cut off by service interruption etc., the embodiment as shown in FIG. 8 is adapted to lower the blind to the lower limit after power reset to close the slats 13.

The MPU 34 determines that power is reset at a step SP61, to confirm the state of the upper limit switch 16 at a step SP62. Upon a determination that the upper limit switch 16 is in an ON state, i.e., that the blind is drawn up to the upper limit, the MPU 34 sets an initialization value at the upper limit value at a step SP66, to rotate the geared motor 4 thereby to lower the blind. However, if the upper limit switch 16 is not in an ON state, the MPU 34 drives the geared motor 4 at a step SP63 until the uPPer limit switch 16 is turned on to raise the blind. Upon a determination that the blind reaches the upper limit position to turn on the upper limit switch 16, the MPU 34 makes the RAM 50 store the upper limit position as an initial value at a step SP64, to stop the geared motor 4 at a step SP65.

After the blind is raised to the upper limit position in the aforementioned manner, the MPU 34 reversely rotates the geared motor 4 at a step SP66, thereby to lower the blind. The MPU 34 counts clock pulses from the photointerrupter 38, and rotates the geared motor 4 until the counter value coincides with the set value of the lower limit switch member 42, to lower the blind. Upon a determination that the pulse number of the photointerrupter 38 coincides with the set value of the lower limit switch member 42 at a step SP67, the MPU 34 determines whether the slats 13 are closed on the basis of the pulse signals from the photointerrupter 41 at a step SP68. Upon a determination that the slats 13 are closed, the MPU 34 brings the geared motor 4 into a stop state at a step SP69, to stop lowering of the blind.

Figure 9:
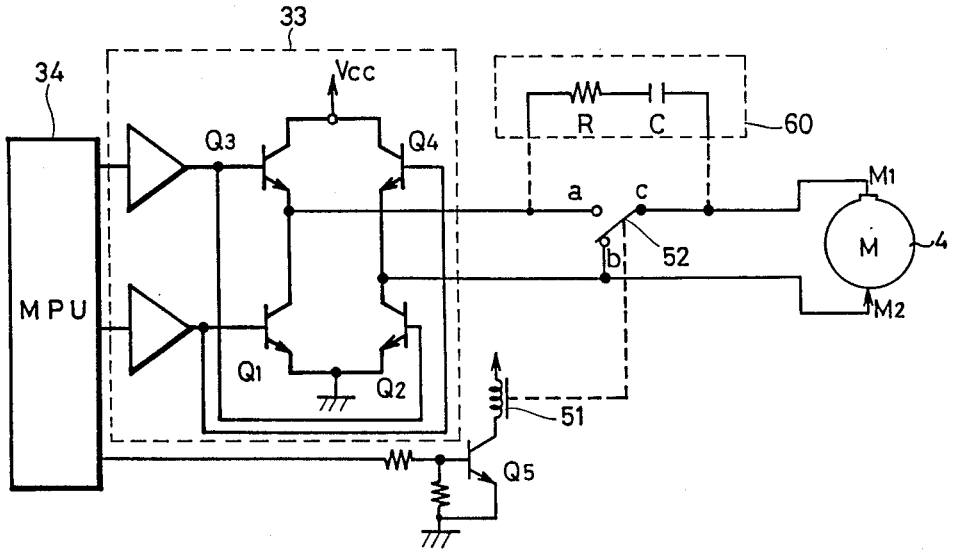
FIG. 9 is an electric circuit diagram of a motor driving circuit as shown in FIG. 3.

FIG. 9 is an concrete electrical circuit diagram of the motor driving circuit as shown in FIG. 3. Referring to FIG. 9, the motor driving circuit 33 includes transistors Q1 to Q4. The base of a transistor Q5 is connected to the MPU 34, while the collector thereof is connected to a relay coil 51 and its emitter is grounded. A relay contact 52 is connected between output of the motor driving circuit 33 and the geared motor 4. The relay contact 52 includes terminals a and b and a common terminal c, such that the terminal a is connected to the motor driving circuit 33 and the terminal b is connected to the motor driving circuit 33 and a terminal M2 of the geared motor 4. The common terminal c is connected to another terminal M1 of the geared motor 4. Thus, the relay contact 52 connects the motor driving circuit 33 and the geared motor 4 with each other upon being switched toward the terminal a, while causing a short across the terminals M1 and M2 of the geared motor 4 upon being switched toward the terminal b.

Figure 10:
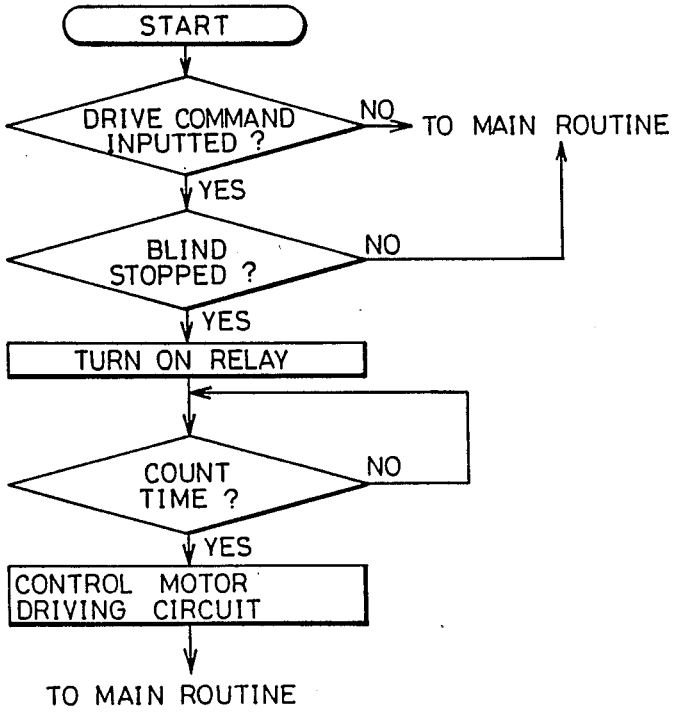
FIG. 10 is a flow chart for illustrating operation of a microcomputer (MPU) for controlling the motor driving circuit.
Figure 11:
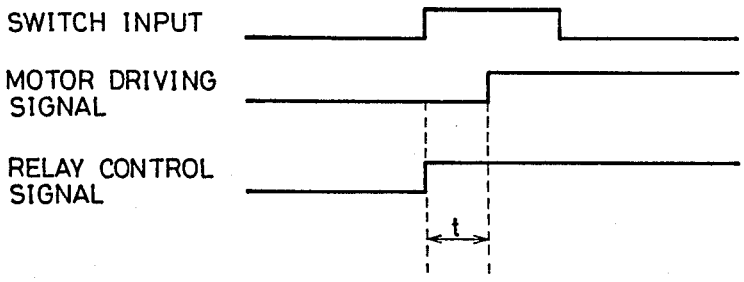
FIG. 11 is a timing chart showing operation for driving a motor.

FIG. 10 is flow chart for illustrating the operation of the MPU for controlling the motor driving circuit as shown in FIG. 9, and FIG. 11 is a timing chart thereof. Referring to FIGS. 9 and 10, description is now made on the operation of this embodiment. When a raising command is received from the aforementioned raising switch 21, the MPU 34 turns on the transistors Q2 and Q3 while turning off the transistors Q1, Q4 and Q5, for raising the blind. As a result, no current flows to the relay coil 51, and hence the common terminal c of the relay contact 52 is switched toward the terminal a. Current flows through a path of the power source $V_{CC}$ - transistor Q3 - relay contact 52 - geared motor 4 - transistor Q2 - GND, so that the geared motor 4 is normally rotated to draw up the blind.

In order to lower the blind, a lowering command is supplied from the lowering switch 23, so that the MPU 34 turns on the transistors Q1 and Q4 while turning off the transistors Q2, Q3 and Q5. As a result, current flows through a path of the power source $V_{CC}$ - transistor Q4 -geared motor 4 - relay contact 52 - transistor Q1 - GND, so that the geared motor 4 is reversely rotated to lower the blind.

A detector (not shown) is provided for detecting that the blind is in the upper limit position upon raising movement. When a detection signal is received from the detector, the MPU 34 determines that the blind is stopped, to turn off the transistors Q1 to Q4 while turning on the transistor Q5. Thus, current flows to the relay coil 51, whereby the common terminal c of the relay contact 52 is switched toward the terminal b. Namely, the terminals M1 and M2 of the geared motor 4 are shorted by the relay contact 52.

Consequently, braking current for the geared motor 4 flows through a path of the terminal Ml - common terminal c - terminal b - terminal M2, for example, to correctly and maximumly apply brake without loss. Even if a control signal is erroneously outputted to the transistor Q1 to Q4 by noise or a malfunction or runaway of the MPU 34, the geared motor 4, being disconnected from the motor driving circuit 33 by the relay contact 52, is prevented from such a malfunction that the blind is erroneously lowered to cause personnel or physical damage.

When the common terminal c of the relay contact 52 is switched toward the terminal a after the transistors Q1 and Q4 or Q2 and Q3 of the motor driving circuit 33 are turned on for bringing the blind into an operating state from a stop state, an excessive arc may be caused by contact with the relay contact 52 to break the motor driving circuit 33 or cause a malfunction of the MPU 34. In order to cope with this, a snubber circuit 60, which is formed by series-connected resistor and capacitor, may be inserted between the terminal a and the common terminal c of the relay contact 52 as shown by dotted lines in FIG. 9, for example, whereas such a snubber circuit 60 leads to increase in cost. Thus, this embodiment employs the following improvement.

When a command for raising or lowering the blind is received, the transistor Q5 is turned on to feed current to the relay coil 51 for releasing the brake state, and a time t required for complete switching of the relay contact 52 is counted. After a lapse of the time t, a motor driving signal is supplied from the motor driving circuit 33 to the geared motor 4. Namely, the relay contact 52 is turned on before the geared motor 4 is driven by the motor driving circuit 33 so that no arc is caused by contact with the relay contact 52, thereby to prevent rupture or malfunction of the apparatus and deposition of the relay contact 52.

Figure 12:
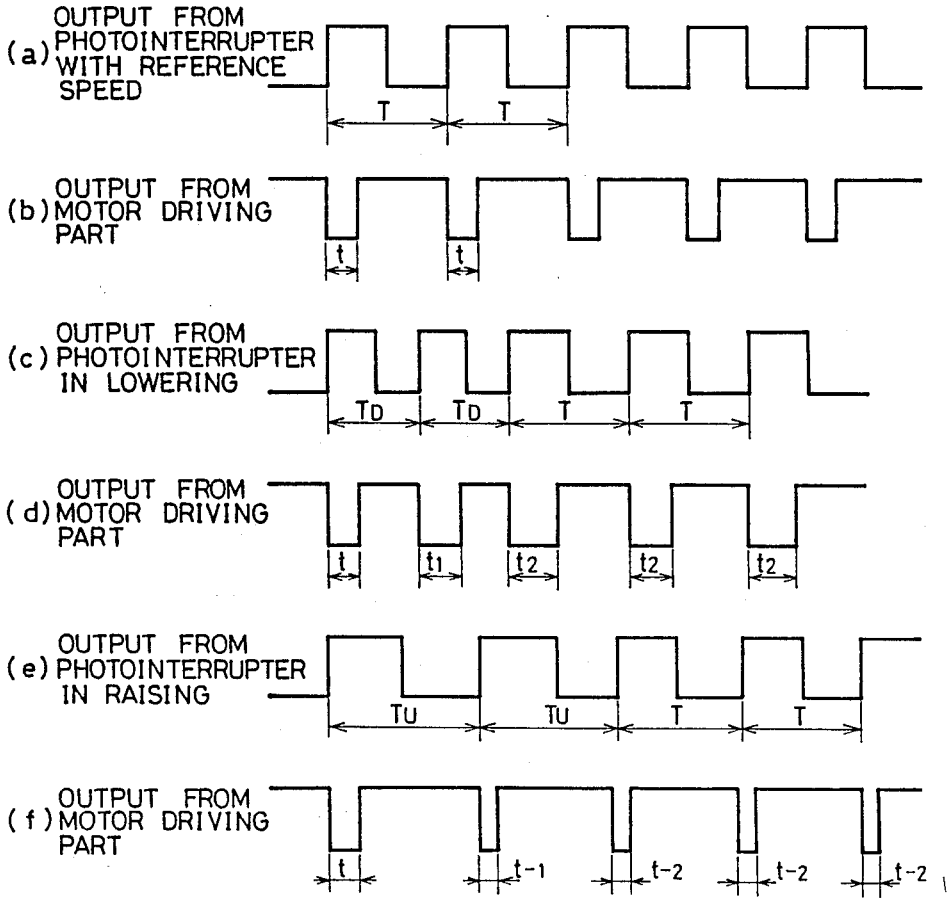
FIG. 12 is a timing chart of respective parts shown in FIG. 3.

FIG. 12 is a timing chart of the respective parts as shown in FIG. 3. Referring to FIGS. 3 and 12, description is made on operation for servo-controlling the geared motor.

When the take-up drum 37 as shown in FIG. 3 is rotated, the slits 373 are rotated and the photointerrupter 38 supplies a pulse signal to the MPU 34 uPon passage of each slit 373. When the slits 373 provided in the guide 371 are constant in width and number, such pulses are generated in a constant cycle upon rotation of the take-up drum 37 at a constant rotational speed. Further, the rotational speed can be judged by counting the pulse number. The rotational speed of the geared motor 4 is set at a relatively high level to be employed with braking by a constant period in the case of the rotational speed of the take-up drum 37, serving as the reference speed.

Referring to FIG. 12, when the take-up drum 37 is rotated at a predetermined reference rotational speed, the pulses are supplied from the photointerrupter 38 to the MPU 34 in a cycle T, as shown at FIG. 12(*a*). At this time, the MPU 34 transmits an energization signal and a braking signal to the motor driving circuit 33. The rotational speed of the geared motor 4 is so set that the braking signal has a period t as shown at FIG. 12(*b*) when the pulse signal has the cycle T.

When the blind is lowered, natural dropping force is applied to the geared motor 4 by the weight of the blind, whereby rotation of the geared motor 4 is accelerated. Namely, the pulse cycle is shortened to $T_D$ as shown at FIG. 12(*c*). Since the pulse cycle $T_D$ is shorter than the reference pulse cycle T, the MPU 34 increases the period t of the braking signal supplied to the geared motor 4 to a period $t_1$ as shown at FIG. 12(*d*), in subsequent pulse input. Then the MPU 34 compares the cycle of the input pulse from the photointerrupter 38 with the reference pulse cycle T, to further increase the braking period to $t_2$ when the pulse of the cycle $T_D$ is inputted, thereby to output the braking signal.

The MPU 34 determines whether the cycle of the pulse signal received from the photointerrupter 38 coincides with the reference cycle T, to output the period $t_2$ of the braking signal to the geared motor 4 upon coincidence, thereby to match rotation of the take-up drum 37 with the reference value. Such operation is regularly performed during rotation of the take-up drum 37, to change the output period t of the braking signal as $t_1-t_2-t_3$ for regular reference rotation. When the blind is raised, a load is applied to the geared motor 4 and hence the cycle becomes $T_U$ as shown at FIG. 12(*e*) to slow down the rotational speed. Thus, the braking period t is reduced to $t_1-t_2$ . . . as shown at FIG. 12(*f*), to increase the time for energizing the geared motor 4. Namely, the power supplied to the geared motor 4 is increased to increase the rotational speed toward the reference speed.

Even if the blind is increased or reduced in size, the MPU 34 judges the cycle of the pulse signals from the photointerrupter 38 in raising or lowering of the blind and compares the same with the reference cycle T of the pulse signals to reduce or increase the braking period, thereby to match the rotational speed with a reference speed for raising/lowering the blind.

The angle of the slats 13 may be adjusted by braking the geared motor 4 in a similar manner, and hence redundant description is omitted. However, it is to be noted that in adjustment of the angle of the slats 13, the geared motor 4 is controlled by pulse signals from the photointerrupter 41 for detecting the angle.

Figure 13:
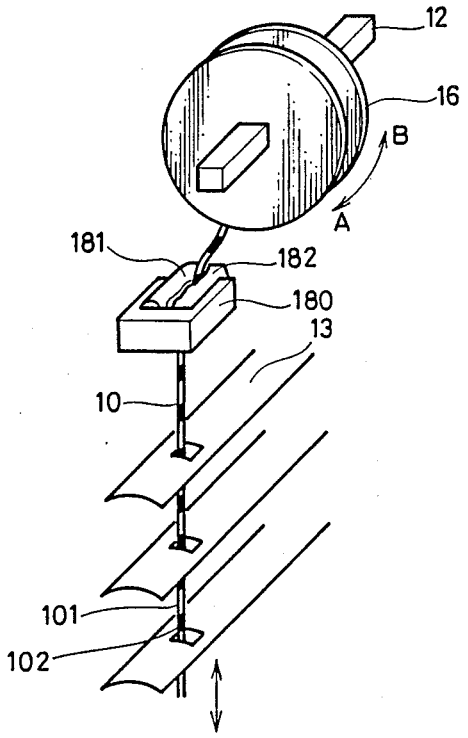
FIG. 13 illustrates another embodiment for detecting vertical positions of the blind.

FIG. 13 illustrates a further embodiment for detecting the vertical position of the blind. A lifting tape 10 is formed by light transmissive parts 101 and non-transmissive parts 102, which are alternately provided in a stripe pattern. A photointerrupter 180 is provided with a light emitting part 181 and a light receiving part 182, which are opposite to each other, to detect whether a shading substance is present between the same. The lifting tape 10 is vertically moved between the light emitting part 181 and the light receiving part 182 of the photointerrupter 180.

When the raising switch 21 or the lowering switch 23 of the controller 2 is operated, the geared motor 4 is normally or reversely rotated. The torque of the geared motor 4 is transmitted to the lifting shaft 12 through the coupling 5. Therefore, the take-up drum 37 coupled to the lifting shaft 12 is rotated in a direction A or B. Thus, the lifting tape 10 is wound up or unwound by the take-up drum 37. At this time, the lifting tape 10 is upwardly or downwardly moved between the light emitting part 181 and the light receiving part 182 of the photointerrupter 180. Thus, light from the light emitting part 181 is intermittently received by the light receiving part 182, whereby the photointerrupter 180 alternately outputs a low-level signal and a high-level signal. Such output signals are supplied to the MPU 34, which in turn counts and stores the same.

Thus, it is possible to return the blind to its original position after raising or lowering movement. Further, the upper limit or lower limit of such vertical movement of the blind may be stored to stop the motor when the blind reaches the limit position.

According to this embodiment as hereinabove described, the vertical position of the blind can be detected at a low cost by simply employing the photointerrupter and the lifting tape of the stripe pattern in a lifting mechanism for the conventional electric blind, whereby an excellent effect can be attained.

Although the light transmissive parts and the non-transmissive parts are alternately provided to form the lifting tape of the stripe pattern in the above embodiment, the lifting tape is not restricted to this but may be formed by alternately providing pairs of parts which are different in reflection factor from each other. In this case, the photointerrupter is replaced by a device for detecting intensity of reflected light.

Although the striped lifting tape is formed by combining two types of members which are different in optical property from each other to detect change in light along the stripe pattern by the photointerrupter in the aforementioned embodiment, the present invention is not restricted to this. For example, members of different magnetic property levels may be combined to structurally form a stripe pattern for detecting magnetic change along the stripe pattern by a magnetic sensor, or members of different conductivity may be combined to form a stripe pattern for detecting change in conductivity along the stripe pattern by an ammeter or the like.

Figure 14A:
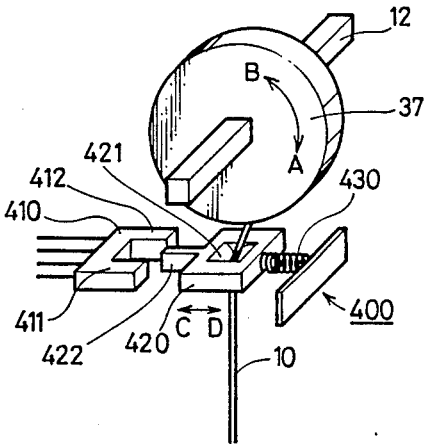
FIGS. 14A, 14B, 15A and 15B are sketch perspective views showing looseness detecting mechanisms.
Figure 14B:
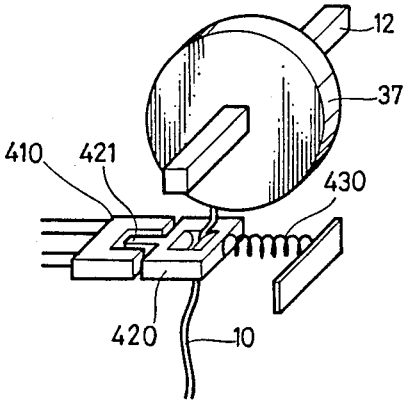

FIGS. 14A and 14B illustrate an example of a looseness detecting mechanism. Referring to FIG. 14A, a looseness detecting part 400 is formed by a photointerrupter 410, a movable member 420 and a coil spring 430. The photointerrupter 410 is provided with a light emitting part 411 and a light receiving part 412, which is opposite to the light emitting part 411 with a constant space. The movable member 420 is provided with a hole 421 which can receive a lifting tape 10 and a projecting part 422 for shielding the light receiving part 412 of the photointerrupter 410 against the light emitting part 411. The movable member 420 is regularly urged against the photointerrupter 410 by elastic force of the coil spring 430.

The operation of this looseness detecting mechanism is now described. When the raising switch 21 or the lowering switch 23 of the controller 2 is operated as hereinabove described, the take-up drum 37 is rotated in a direction A or B. If the blind is in a normal state, tension is applied to the lifting tape 10 by the weight of the bottom rail 14, whereby the movable member 420 is urged toward a direction D by the tension. Thus, the projecting member 422 of the movable member 420 is separated from the photointerrupter 410. Thus, when tension is applied to the lifting tape 10, the projecting part 422 is not present between the light emitting part 411 and the light receiving part 412 of the photointerrupter 410, whereby the light from the light emitting part 411 is not intercepted and the light receiving part 412 outputs a light detecting signal.

When lowering of the bottom rail 14 is prevented by an obstacle or the like, the lifting tape 10, being pulled down by the bottom rail 14, is loosened and hence the movable member 420 is urged toward a direction C by elastic force of the coil spring 430. Thus, the projecting part 422 of the movable part 420 enters the space between the light emitting part 411 and the light receiving part 412 of the photointerrupter 420 to intercept the light emitted from the light emitting part 411, whereby the light receiving part 412 detects no light. Detection output from the light receiving part 412 is supplied to the MPU 34 as shown in FIG. 3, so that the MPU 34 stops rotation of the geared motor 4 when no detection signal is received from the photointerrupter 410.

Figure 15A:
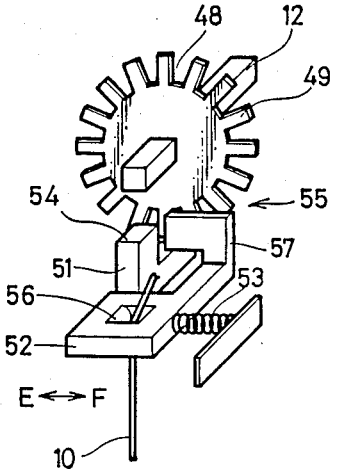
Figure 15B:
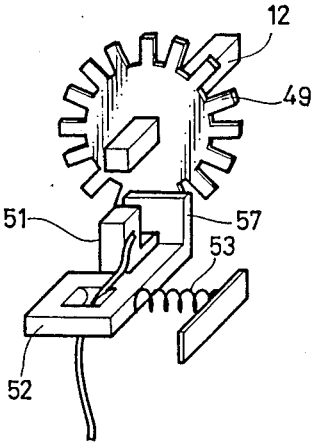

FIGS. 15A and 15B are illustrative of another example of the looseness detecting mechanism, which is formed by combining a looseness detecting mechanism and a blind position detecting mechanism. The lifting shaft 12 is coupled with a disc 49, which is formed in its periphery with slits 48. A photointerrupter 51 is so provided that a light emitting part 54 and a light receiving part 55 thereof are located on both sides of the disc 49. This photointerrupter 51 is provided in place of the photointerrupter 38 as shown in FIG. 3. Namely, when the disc 49 is rotated with rotation of the lifting shaft 12, the photointerrupter 51 detects interruption of light emitted from the light emitting part 54 by the slits 48. The detection signal is supplied to the MPU 34 as an electric signal indicating the amount of upward or downward movement of the lifting tape 10.

A movable member 52 is provided with a hole 56 which can receive the lifting tape 10 and a projecting part 57. The projecting part 57 is adapted to intercept light emitted from the light emitting part 54 of the photointerrupter 51 when the lifting tape 10 is loosened. The movable member 52 is urged against the photointerrupter 53 by elastic force of a coil spring 53, similarly to the example as shown in FIG. 14A.

Also similarly to the example as shown in FIGS. 14A and 14B, the other end of the lifting tape 10 passes through the hole 56 formed in the movable member 52, to be fixed to the bottom rail 14.

The operation of this example is now described. When the blind is in a normal state, tension is applied to the lifting tape 10 by the weight of the bottom rail 14, whereby the movable member 42 is urged toward a direction F. Thus, the projecting part 57 provided in the movable member 52 is separated from the photointerrupter 51. Therefore, the light emitted from the light emitting part 54 is not intercepted when the tension is applied to the lifting tape 10, and hence the light receiving part 55 outputs a light detection signal.

On the other hand, when the bottom rail 14 touches an obstacle or the slats 13 are caught by something during downward movement to loosen the lifting tape 10, the movable member 52 is urged toward a direction E by elastic force of the coil spring 53. Thus, the projecting part 57 of the movable member 52 enters the space between the light emitting part 54 and the light receiving part 55 of the photointerrupter 51 to intercept the light emitted from the light emitting part 54, whereby the light receiving part 55 outputs no light detection signal. The MPU 34 stops rotation of the geared motor 4 when no light detection signal is received from the light receiving part 55.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electric blind apparatus for raising/lowering a plurality of strip-shaped vanes forming a blind by driving an electric motor, said electric blind apparatus comprising:

an electric motor; a plurality of strip-shaped vanes;

a cord-like member for raising/lowering said plurality of vanes by driving force of said electric motor;

vane opening/closing means for simultaneously opening/closing said plurality of vanes by driving force of said electric motor;

lifting means being rotated in response to rotation of said electric motor to wind or unwind said cord-like member for raising/lowering said blind, said lifting means includes a rotary drum driven by said electric motor for winding or unwinding an end of said cord-like member;

rotational speed detecting means for detecting the rotational speed of the rotary drum;

command means for commanding raising/lowering and stoppage of said blind and opening/closing of said plurality of vanes; and control means for driving said electric motor in response to a raising/lowering command from said command means to raise/lower said blind by said lifting means and driving said electric motor by an opening/closing command from said command means to open/close said plurality of vanes by said vane opening/closing means, said control means further including vertical position judging means for judging the vertical position of said blind by counting detecting output of said rotational speed detecting means.

2. The electric blind apparatus in accordance with claim 1, further including lower limit set means for setting the lower limit position of said blind, said control means including means for stopping said electric motor in response to a judgement, being made by said vertical position judging means, of downward movement of said blind to said lower limit position set by said lower limit set means.

3. The electric blind apparatus in accordance with claim 2, further including power supply detecting means for detecting power supply, said control means including means for rotating said electric motor until said blind is lowered to said lower limit position set by said lower limit set means in response to detection of said power supply by said power supply detecting means.

4. The electric blind apparatus in accordance with claim 1, further including rotational speed judging means for judging whether detection outputs from said rotational speed detecting means are provided by a prescribed number within a predetermined period from supply of a command for raising/lowering said blind from said command means, said control means including means for stopping said electric motor in response to a judgement, being made by said rotational speed judging means, that said detection outputs fail to be provided in said prescribed number.

5. The electric blind apparatus in accordance with claim 1, further including raising position detecting means for detecting that said blind is raised to a maximum raising position, said control means including means for stopping said electric motor in response to a judgement, being made by said raising position detecting means, that said blind is raised to said maximum raising position.

6. The electric blind apparatus in accordance with claim 1, wherein said electric motor includes a DC motor having terminals being supplied with DC driving voltage from said control means, said control means including means for causing a short across said terminals of said DC motor during stoppage of said DC motor.

7. An electric blind apparatus for raising/lowering a plurality of strip-shaped vanes forming a blind by driving an electric motor, said electric blind apparatus comprising:

an electric motor; a plurality of strip-shaped vanes;

a first cord-like member for raising/lowering said plurality of vanes by driving force of said electric motor;

vane opening/closing means for simultaneously opening/closing said plurality of vanes by driving force of said electric motor, said vane opening/-closing means further including, a pair of second cord-like members coupled to shorter-side ends of each of said plurality of vanes, a rotary drum to which ends of said second cord-like members are fixed, said rotary drum being rotated by driving force of said electric motor for winding one of said pair of second cord-like members, thereby simultaneously adjusting the open/close angle of said plurality of vanes;

lifting means being rotated in response to rotation of said electric motor to wind or unwind said first cord-like member for raising/lowering said blind;

command means for commanding raising/lowering and stoppage of said blind and opening/closing of said plurality of vanes;

pulse signal generating means for generating pulse signals in response to rotation of said rotary drum; and control means for driving said electric motor in response to a raising/lowering command from said command means to raise/lower said blind by said lifting means and driving said electric motor by an opening/closing command from said command means to open/close said plurality of vanes by said vane opening/closing means, said control means further including open/close angle judging means for rotating said rotary drum by said electric motor in response to an opening/closing command from said command means and for counting said pulse signals generated from said pulse signal generating means to judge the open/close angle of said vanes.

8. The electric blind apparatus in accordance with claim 7, further including memory means for storing said open/close angle of said vanes judged by said open/close angle judging means, said control means including means for controlling said electric motor to make said memory means store said open/close angle judged by said open/-close angle judging means in response to a command from said command means and thereafter to raise/lower said blind.

9. The electric blind apparatus in accordance with claim 8, wherein said control means includes means for stopping said electric motor in response to a stop command from said command means and thereafter driving said electric motor so that said open/close angle judged by said open/close angle judging means coincides with said open/close angle stored in said memory means, thereby to open/close said vanes by said vane opening/closing means.

10. An electric blind apparatus for raising/lowering a plurality of strip-shaped vanes forming a blind by driving an electric motor, said electric blind apparatus comprising:

an electric motor; a plurality of strip-shaped vanes;

a cord-like member for raising/lowering said plurality of vanes by driving force of said electric motor;

vane opening/closing means for simultaneously opening/closing said plurality of vanes by driving force of said electric motor;

lifting means being rotated in response to rotation of said electric motor to wind or unwind said cord-like member for raising/lowering said blind;

command means for commanding raising/lowering and stoppage of said blind and opening/closing of said plurality of vanes;

a movable member which is moved horizontally in response to tension on said cord-like member;

looseness detecting means for detecting horizontal movement of said movable member following loosening of said cord-like member; and control means for driving said electric motor in response to a raising/lowering command from said command means to raise/lower said blind by said lifting means and driving said electric motor by an opening/closing command from said command means to open/close said plurality of vanes by said vane opening/closing means, said control means further includes means for stopping said electric motor in response to detection of looseness of said cord-like member by said control means.

11. The electric blind apparatus in accordance with claim 10, wherein said movable member detecting means includes:

a light emitting part for emitting light, and a light receiving part provided opposite said light emitting part by a prescribed space for detecting looseness of said cord-like member when said light from said light emitting part is intercepted in response to horizontal movement of said movable member.

12. An electric blind apparatus for raising/lowering a plurality of vanes of a blind and adjusting the angle of said vanes in response to rotation of an electric motor, said electric blind apparatus comprising:

an electric motor; a plurality of strip-shaped vanes;

lifting means for winding or unwinding a cord-like member coupled to said plurality of vanes in response to rotation of said motor to raise/lower said blind;

vertical position detecting means for detecting the vertical position of said blind;

angle detecting means for detecting the angle of said vanes;

trouble detecting means for detecting trouble in raising/lowering of said cord-like member;

upper limit detecting means for detecting that said blind is raised to an upper limit position;

lower limit set means for setting a lower limit position for said blind;

command means for commanding raising and lowering of said blind and opening/closing of said vanes; and control means for raising said blind by said lifting means in response to a raising command from said command means, stopping said electric motor in response to a detection signal from said upper limit detecting means, lowering said blind by said lifting means in response to a lowering command from said command means, stopping said electric motor when a vertical position of said blind detected by said vertical position detecting means coincides with said lower limit position set by said lower limit set means, stopping said electric motor when a detection signal is outputted from said trouble detecting means during raising/lowering of said blind and controlling said electric motor in response to detection output from said angle detecting means in response to supply of a command for opening/closing said vanes from said command means to control the angle of said vanes.

13. An electric blind apparatus for raising/lowering a plurality of strip-shaped vanes forming a blind by driving and electric, said electric motor blind apparatus comprising:

an electric motor; a plurality of strip-shaped vanes;

a cord-like member for raising/lowering said plurality of vanes by driving force of said electric motor, said cord-like member includes indicators for optically detecting the vertical position of said blind, said plurality of vanes each including a holes for receiving said cord-like member;

vane opening/closing means for simultaneously opening/closing said plurality of vanes by driving force of said electric motor;

lifting means being rotated in response to rotation of said electric motor to wind or unwind said cord-like member for raising/lowering said blind;

a member provided under said plurality of vanes connected to an end of said cord-like member, said member pressing said plurality of vanes sequentially upwardly from a lower part thereof upon rotation of said lifting means during raising of said blind;

command means for commanding raising/lowering and stoppage of said blind and opening/closing of said plurality of vanes;

indicator means for detecting said indicators of said cord-like member; and control means for driving said electric motor in response to a raising/lowering command from said command means to raise/lower said blind by said lifting means and driving said electric motor by an opening/closing command from said command means to open/close said plurality of vanes by said vane opening/closing means, said control means further including means for judging the vertical position of said blind in response to detection output from said indicator means.

* * * * *